United States Patent [19]

Hung

[11] Patent Number: 4,472,766

[45] Date of Patent: Sep. 18, 1984

[54] TORCH

[75] Inventor: Kung C. Hung, Hong Kong, Hong Kong

[73] Assignee: Freezinhot Bottle Co. Ltd., Hong Kong, Hong Kong

[21] Appl. No.: 339,396

[22] Filed: Jan. 15, 1982

[30] Foreign Application Priority Data

Jan. 28, 1981 [GB] United Kingdom ..... 8102619

[51] Int. Cl.[3] ..... F21L 7/00

[52] U.S. Cl. ..... 362/158; 362/202; 362/203; 362/205

[58] Field of Search ..... 362/158, 202, 203, 205

[56] References Cited

U.S. PATENT DOCUMENTS

| | | | |
|---|---|---|---|
| 2,867,717 | 1/1959 | Forquer | 362/203 |
| 4,203,150 | 5/1980 | Shamlian | 362/183 |
| 4,234,913 | 11/1980 | Ramme | 362/203 |
| 4,286,310 | 8/1981 | Brainkel | 362/203 |

FOREIGN PATENT DOCUMENTS

| | | | |
|---|---|---|---|
| 1271830 | 9/1960 | France | 362/203 |
| 2372382 | 7/1978 | France | 362/203 |
| 555910 | 9/1943 | United Kingdom . | |
| 586357 | 3/1947 | United Kingdom . | |
| 752619 | 7/1956 | United Kingdom . | |
| 1006368 | 9/1965 | United Kingdom . | |

*Primary Examiner*—Donald P. Walsh

*Attorney, Agent, or Firm*—Price, Heneveld

[57] ABSTRACT

The present invention relates to torches. The torch described herein has two components which together define a case containing battery means and a bulb, with a seal located between the two components. The torch is operated by causing relative movement between the two components.

1 Claim, 1 Drawing Figure

TORCH

SUMMARY OF THE INVENTION

Such a torch may be easily operated by the user grasping both components and effecting the relative movement and does not require actuating a small switch which may be difficult to find and vulnerable to knocks. The present torch is particularly, although not exclusively, of use to divers who may be working in very dark conditions making the finding of any switch difficult. With the present torch, the diver can cause the relative movement between the two components, even though he may be wearing thick gloves which do not allow intricate movements to be made by his hands. Furthermore, the torch may present an exterior substantially free from small projections which may hinder the user.

The provision of a seal between the two components means that any water, which would damage the battery means and the bulb, is prevented from entering the case of the torch.

The torch described herein connnects the two components by means of co-operating screw threads, and the translational movement caused by relative rotation between the two components determines whether or not the torch is in the ON or OFF position. Thus the torch can not be knocked accidentally into the ON or OFF position. The torch also has a protective skirt covering the join between the two components.

BRIEF DESCRIPTION OF DRAWING

The accompanying drawing is a longitudinal section through the torch.

DESCRIPTION OF PREFERRED EMBODIMENT

Figure 1:
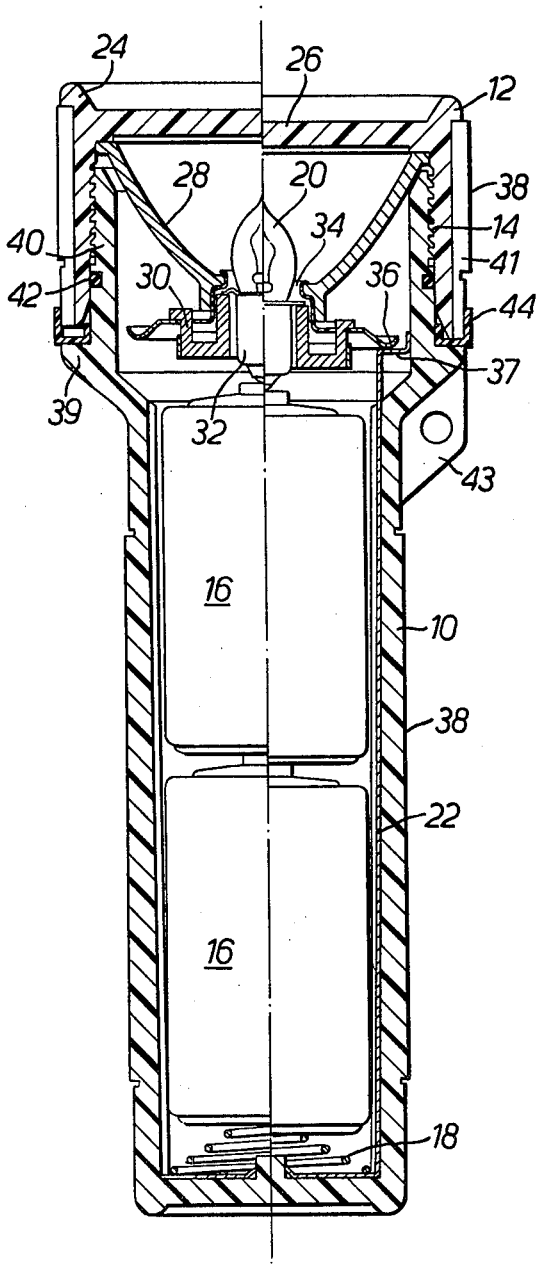

The torch shown comprises a lower tubular casing constituting a handle 10 and an open-ended cylindrical casing 12 which threadably engage each other, as shown at 14.

The right and left hand sides respectively of the section show the casings 10 and 12 in positions in which the torch is ON and OFF. The torch is switched on and off by relatively rotating the casings 12 and 10 on the threads 14 to cause relative axial movement.

The lower part of the casing 10 houses two batteries 16 which are biased upwardly by a spring 18 so that the central contact of the upper battery contacts the control contact of a light bulb 20. The spring 18 also acts as a contact against the case of the lower battery and connects to the top of the torch by a copper strip 22.

The casing 12 is transparent and has a recessed front window 26 protected by a shoulder 24.

A reflector 28 is secured behind the rim of the window 26 and carries a copper contact disc 36 around the edge of a central bulb hole. The disc 36 in turn carries a holder 30 for the bulb 20 with the bulb stem in contact with the disc 36.

When the casing 12 is screwed into the ON position the disc 36 makes contact with a tab 37 at the top of the copper strip 22 and completes a circuit through the batteries and the bulb. The torch is switched OFF by rotating the casings 10 and 12 relatively to one another to cause the disc 36 to disengage from the tab 37 and open the circuit.

The casings 10 and 12 and the reflector 28 are moulded of plastics material so that the torch is robust and cheap to manufacture.

The lower casings have knarled cylindrical surfaces 38 for ease of operation.

The lower casing 10 has an annular groove 40 below the threads and that houses an O-ring 42 which cooperates with a smooth skirt below the thread on the upper casing 12 to prevent water from entering the interior of the torch. A further seal is provided by a U-section plastics skirt 44 sealed around an external shoulder 39 on the lower casing and making a sliding seal with an internal knarled collar 41 around the casing 12 in both the ON and OFF positions.

The handle casing 10 has an integral lug 43 for a carrying cord.

Obviously, numerous modifications and variations of the present invention are possible in the light of the above teachings. It is therefore to be understood that within the scope of the appended claims the invention may be practised other than as specifically described herein.

I claim:

1. An electic torch comprising:

a cylindrical body member closed at one end and open at the other end, said other end of said body member having an enlarged shell-like portion and a radially extending circumferential rib surrounding said body member substantially at the juncture of said shell-like portion and the remainder of said body member, said shell-like portion of said body member being externally threaded, a circumferential channel in the external surface of said shell-like portion opening through the outer surface thereof between said threading and said rib;

a cylindrical head member having one closed end defining a transparent window, the other end thereof being open, said head member being internally threaded to be received on said body member;

a bulb socket and reflector assembly in said shell-like portion;

a pair of electrical contacts forming a switch enclosed within said torch, one being mounted in and stationary with said body member and the other movable with said head member for opening and closing said switch as said head is turned about said body member;

an annual seal in said channel engaging the internal surface of said open end of said head member to provide a watertight joint between said head and body members;

an annual skirt member of U-shaped cross section having its open face directed toward said head member, said skirt member seated on said rib and telescopically receiving said open end of said head member therein the depth of said skirt member being such that said open end of said head member is located therein when said switch is both opened and closed.

* * * * *